US008262515B2

(12) United States Patent
Morris

(10) Patent No.: US 8,262,515 B2
(45) Date of Patent: Sep. 11, 2012

(54) ATHLETIC TRAINING METHOD, SYSTEM, AND APPARATUS

(76) Inventor: Desmond V. Morris, Greenwich, CT (US)

( * ) Notice: Subject to any disclaimer, the term of this patent is extended or adjusted under 35 U.S.C. 154(b) by 0 days.

(21) Appl. No.: 13/178,458

(22) Filed: Jul. 7, 2011

(65) Prior Publication Data

US 2012/0010027 A1 Jan. 12, 2012

Related U.S. Application Data

(60) Provisional application No. 61/362,235, filed on Jul. 7, 2010.

(51) Int. Cl.
*A63B 69/00* (2006.01)

(52) U.S. Cl. ..... 473/420; 473/422; 473/446

(58) Field of Classification Search ..... 473/422, 473/420, 427, 429, 438, 446, 423
See application file for complete search history.

(56) References Cited

U.S. PATENT DOCUMENTS

| | | | | |
|---|---|---|---|---|
| 2,008,359 | A * | 7/1935 | Lamb | 273/402 |
| 3,498,613 | A * | 3/1970 | Dreyer | 473/575 |
| 3,529,823 | A * | 9/1970 | Garver | 473/418 |
| 4,364,563 | A | 12/1982 | Stafford | |
| 4,616,834 | A * | 10/1986 | Davis | 473/429 |
| 5,303,914 | A * | 4/1994 | Cooksey | 473/429 |
| 5,553,848 | A * | 9/1996 | Amron | 473/416 |
| 6,475,108 | B1 * | 11/2002 | Sarenana et al. | 473/420 |
| 6,672,979 | B2 | 1/2004 | Brenneisen | |
| D563,496 | S * | 3/2008 | Hawkins | D21/717 |
| 7,364,517 | B1 * | 4/2008 | Johnsen | 473/446 |
| 7,527,567 | B2 * | 5/2009 | Ohle | 473/422 |
| 7,771,294 | B2 * | 8/2010 | Goucher et al. | 473/451 |
| 7,775,912 | B2 * | 8/2010 | Aguirre | 473/423 |
| 7,811,183 | B1 * | 10/2010 | Ohle | 473/429 |
| 2010/0130312 | A1 * | 5/2010 | Fuentes | 473/429 |

* cited by examiner

*Primary Examiner* — Mitra Aryanpour
(74) *Attorney, Agent, or Firm* — Knobbe Martens Olson & Bear LLP

(57) ABSTRACT

Apparatuses, systems, and methods are disclosed herein for aiding a user in learning and practicing techniques for performing a volley kick of a soccer ball. A volley kick training apparatus, as disclosed herein, is configured to position and hold a soccer ball to simulate to a user the scenario of kicking a soccer ball while in mid air to perform and achieve the volley kick.

20 Claims, 7 Drawing Sheets

ATHLETIC TRAINING METHOD, SYSTEM, AND APPARATUS

CROSS-REFERENCE TO RELATED APPLICATIONS

The present application claims the benefit under 35 U.S.C. 119(c) of U.S. Provisional Application No. 61/362,235, filed Jul. 7, 2010, which is hereby incorporated by reference in its entirety.

BACKGROUND

1. Field

Embodiments of the invention relate to the field of athletic training, and more particularly, to methods, devices and systems for teaching and training soccer athletes to perfect the volley kick.

2. Description of the Related Art

In general, a volley kick is an airborne strike of a ball, for example, a soccer ball. A volley kick can be extremely difficult to aim because the ball is struck while it is passed in the air. Accordingly, an athlete must possess good foot-eye coordination and timing in order to successfully execute a volley kick. Generally, the volley kick requires that the athlete strike the ball with the front of his foot, ankle locked, and the knee lifted. A great volley kick inspires a collective awe from the fans in the stands. If the shot goes in and hits the back of the net, the crowds usually erupt in loud celebration.

Generally, the easiest time to strike a ball with power is when the ball is already off the ground. By striking the ball while it is in the air, an athlete does not first need to trap the ball. Taking an extra touch to trap the ball allows the goalkeeper a few extra seconds to react. To execute a volley kick an athlete generally needs to determine the location of a ball within the air. The athlete then turns throwing his or her knee and hand upward to gain height. The athlete then kicks and strikes the ball and lands on the kicking foot. Often an athlete will have to jump in the air in order to successfully complete a volley kick. Accordingly, it is very difficult to make contact with the ball let alone accurately kick the ball into the goal while in mid air. However a properly executed volley kick imparts a great deal of spin and prevents the ball from flying wildly over the goal if done correctly. Because of the power and the spin imparted on the ball, the shot can follow an unpredictable path to the goal and prove difficult to defend against. Therefore, the volley kick can play a crucial role in scoring goals.

SUMMARY

In an embodiment, a volley kick training system comprises a central post connected to a base configured to secure the central post to the ground. The volley kick training system can further comprise at least one extension arm coupled to a holding mechanism configured to hold a ball. The holding mechanism can comprise a hoisting apparatus to throw, lift, or send the ball above or from the holding mechanism. The hoisting apparatus can be connected to a control module configured to control the operations of the hoisting apparatus. The control module can be in communication with the ball to determine a time when a user has struck the ball. In an embodiment, the system comprises a goal having a netting, wherein a plurality of sensors are coupled to the netting. The plurality of sensors can be in communication with the control module to determine the time when and/or the location where the ball has struck the net. In certain embodiments, the control module can be configured to output the speed of the ball based on the time when the ball was struck and the time when the ball struck the net. The control module can be configured to output a recommendation for improving the user's volley kick based on the speed of the ball and the location where the ball hit the net.

For purposes of this summary, certain aspects, advantages, and novel features of the invention are described herein. It is to be understood that not necessarily all such aspects, advantages, and features may be employed and/or achieved in accordance with any particular embodiment of the invention. Thus, for example, those skilled in the art will recognize that the invention may be embodied or carried out in a manner that achieves one advantage or group of advantages as taught herein without necessarily achieving other advantages as may be taught or suggested herein.

BRIEF DESCRIPTION OF THE DRAWINGS

The foregoing and other features, aspects and advantages of the invention are described in detail below with reference to the drawings of various embodiments, which are intended to illustrate and not to limit the invention. The drawings comprise the following figures in which:

FIG. 3 is an embodiment of an arm component of the apparatus shown in

FIG. 2.

DESCRIPTION OF THE EMBODIMENTS

Figure 1:
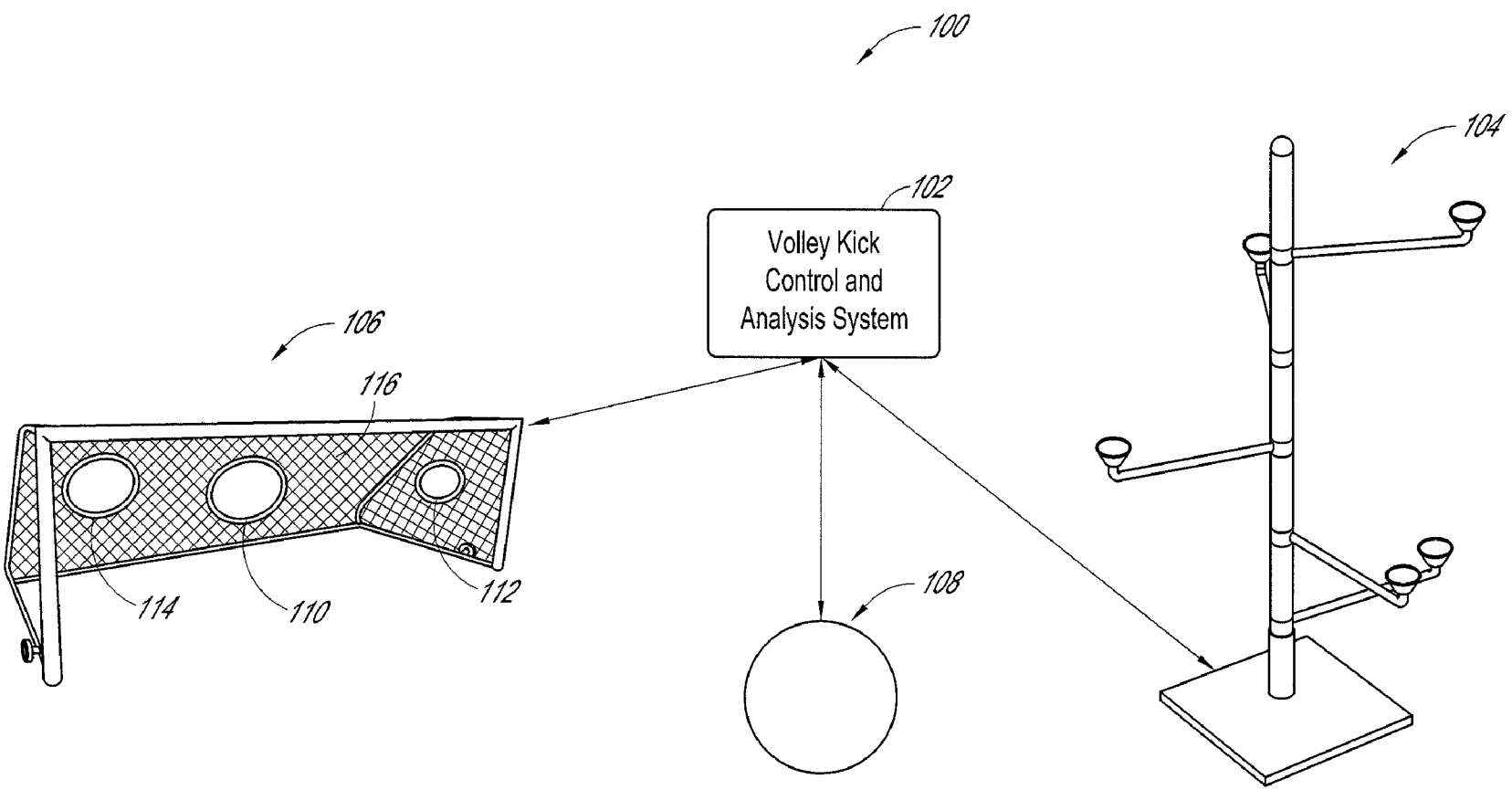
FIG. 1 is a diagram depicting an embodiment of a volley kick control and analysis system.

Although several embodiments, examples and illustrations are disclosed below, it will be understood by those of ordinary skill in the art that the invention described herein extends beyond the specifically disclosed embodiments, examples and illustrations and includes other uses of the invention and obvious modifications and equivalents thereof. Embodiments of the invention are described with reference to the accompanying figures, wherein like numerals refer to like elements throughout. The terminology used in the description presented herein is not intended to be interpreted in any limited or restrictive manner simply because it is being used in conjunction with a detailed description of certain specific embodiments of the invention. In addition, embodiments of the invention can comprise several novel features and no single feature is solely responsible for its desirable attributes or is essential to practicing the inventions herein described.

In general, the apparatuses, systems, and methods disclosed herein teach soccer players and other athletes the technique of performing a volley kick while the ball is still in the air. Although the volley kick is the most powerful kick in soccer, it is one of the most difficult skills to learn and/or perfect in the sport. Accordingly, the volley kick is becoming in general a lost art. The systems, methods, and apparatuses disclosed herein help to improve an athlete's volley kick technique through repetition, practice, and feedback generated by a computer system that is monitoring an athlete's volley kicks and performance. The volley kick training apparatus enables repetitive practice of this unique and complicated skill. The volley kick training apparatus allows a user to focus on: leg extension, trajectory aiming, follow through, accuracy, contact point, balance, leg rotation, and getting the ball in the net.

In an embodiment, the volley kick training apparatus, as disclosed herein, is configured to position and hold a soccer ball in mid air to simulate to a user the scenario and sensation of kicking a soccer ball while the ball is in mid flight or in the air. For example, the volley kick training apparatus can comprise a base portion, a post portion, and one or more arm portions.

The base portion can be coupled to the post portion in order to allow the post portion to stand vertical. The one or more arm portions can be figured to be coupled to the post portion at various points along the height of the post portion as the post portion stands vertically on the base portion. In an embodiment, the post portion can be coupled or connected to the base portion such that the post portion is positioned at a 90 degree angle (or substantially 90 degrees, for example, +/−1-5 degrees) relative to the base portion. In other embodiments, the post portion is positioned at an angle other than 90 degrees relative to the base portion (for example, 110 degrees) and the arm portions are positioned such they are substantially parallel relative to the base portion. By positioning the post portion at an angle other than 90 degrees, this configuration can be advantageous in providing the user more space to kick the ball by moving a part of the post portion away from the user's foot, which can also increase user safety. In an embodiment, the post portion can comprise aluminum, plastic, wood, or other like materials. In an embodiment, the post portion can comprise a wooden notch portion at the top of the post portion.

The one or more arm portions can be configured to extend cantilevered in a radial direction with respect to the post portion. In an embodiment, the one or more arm portions can be manufactured from materials including but not limited to aluminum, rubber, plastic, foam, or the like. In an embodiment, the one or more arm portions can comprise an aluminum center surrounded by a form and/or plastic portion. The one or more arm portions can have a first end that is connected to the post portion. The one or more arms can have a second end that is coupled to a soccer ball holder apparatus. The soccer ball holder apparatus can be configured to hold a soccer ball at a particular position above the ground.

In practice, a user can generally see the location of the ball positioned at a particular height above the ground, and then make an approach to the soccer training apparatus with the intent to perform a volley kick that results in kicking the soccer ball off the soccer ball holder. In approaching the soccer training apparatus, the user may generally run and/or jump and/or twist his body to perform a volley kick that results in allowing the user to make contact with the soccer ball with his foot. In kicking the ball off the soccer ball holder, the user's foot may make contact with the soccer ball holder before making contact with the soccer ball.

In an embodiment, the soccer ball holder is manufactured of a silicone material that is sufficiently stiff to hold the soccer ball within the soccer ball holder, yet sufficiently soft and/or flexible to prevent injury to the user when and if the user makes contact with the soccer ball holder. In an embodiment, the soccer ball holder comprises side walls that are about 1/16 of an inch thick, and in other embodiments, the side wall thickness can be between 1/32 of an inch to 1/4 of an inch thick. In an embodiment, the side wall thickness does not taper but in other embodiments, the side wall thickness can taper towards the top rim of the soccer ball holder.

In an embodiment, the soccer ball holder covers only about a quarter inch, a half inch, or one inch of a soccer ball. In an embodiment, the soccer ball holder covers less than about a quarter inch, a half inch, or one inch of a soccer ball. In an embodiment, the soccer ball holder covers between about a quarter inch and one inch of a soccer ball. In other embodiments, the soccer ball holder covers less than about a half, a third, or a quarter of the soccer ball. Generally, a standard soccer ball comprises a circumference of not more than 70 cm (28 inches) and not less than 68 cm (27 inches), and weigh no more than 450 g (16 oz) and not less than 410 g (14 oz); however, other dimensions are possible. It can be advantageous to cover as little of the soccer ball as possible, but yet sufficiently enough to hold the soccer ball, because this allows the user to make full contact with the soccer ball, as opposed to making full contact or partial contact with the soccer ball holder. By reducing and/or eliminating contact between the user's foot and the soccer ball holder, the volley kick training apparatus can better simulate a ball positioned in mid air while a user is attempting to perform a volley kick.

In an embodiment, the cup holder can be configured to form a seal around the soccer ball positioned within the soccer ball holder, in order to prevent the soccer ball from falling out of the holder due to wind, positioning of the soccer training apparatus on a slope, or other environmental factors that may cause the soccer ball to fall out unintentionally from the soccer ball holder. The seal made between the soccer ball and the soccer ball holder can be generated from a suction formed between the silicon soccer holder and the soccer ball. In an embodiment, the seal formed between the soccer ball and the soccer ball holder is merely a friction grip due to the elastic nature of the silicon holder and/or the tacky surface of the soccer ball holder. In an embodiment, the soccer ball holder does not have a tacky surface but rather is coated with a material or comprises a smooth silicone material to allow the soccer ball to slide off smoothly. In an embodiment, the soccer ball holder is coated with a colored coating.

The apparatus can have one, two, three, or more levels or heights to accommodate different athletes and skill levels. The lowest level will help younger players (for example ages six-ten) train and perform the volley kick. The higher levels will help older player or advanced players train and perform the volley kick. The levels of the apparatus can be adjusted depending upon player's age and skill. The apparatus can also have two sides for left-footed players and for right-footed players. The apparatus can improve an athlete's leg extension, rotation, and follow-through during a volley kick. Accordingly, the apparatus offers players the opportunity to hone their volley kick skills, which is very difficult and becoming increasingly rare.

FIG. 1 is a diagram illustrating an embodiment of an athletic training apparatus 100 that players can use to perfect their volley kick skills. The volley kick control and analysis system 102 can connect to a variety of components. For example the volley kick control and analysis system 102 can connect to a ball holding apparatus 104. The system 102 can also connect to a net or goal apparatus 106 and/or a ball 108. The connection between the system 102 and the one or more components can be a wired or wireless connection or a combination thereof. For example, the volley kick control and analysis system 102 can be connected to the ball's support apparatus 104 by a wire. The system 102 can transmit instructions electronically through the wire to control the ball holding apparatus 104. The system 102 can also receive data taken and/or measured by the ball holding apparatus 104. In an embodiment, the ball 108 comprises a wireless transmitter for sending and receiving data to and from the system 102. For example, the ball 108 can transmit data relating to when a player has struck the ball and/or the rotational speed of the ball and/or the position and/or trajectory of the ball. Accordingly, the ball 108 can comprise a processer, power source, and a plurality of detecters for detecting when a player has struck the ball, determining rotational speed of the ball, and/or the ball's trajectory. The power source can comprise a battery and/or a solar power cell for recharging the battery.

The goal 106 can comprise netting. In an embodiment, the netting can comprise targets 110, 112, 114 that are painted, adhered, coupled to the netting. Athletes can use the targets as a point and/or a location and/or area at which to aim the ball. The netting 116 can comprise a plurality of detectors and/or sensors that can be configured to detect where the ball has struck the net. The ball strike location data can be transmitted over a wired or wireless connection to system 102. The system 102 can collect, store, and analyze the data received from the goal 106, the ball 108, and/or the ball holding apparatus 104. Based on an analysis of the data, the volley kick control and analysis system 102 can generate a report and/or a recommendation for the athlete to improve his volley kick skills.

Figure 2A:
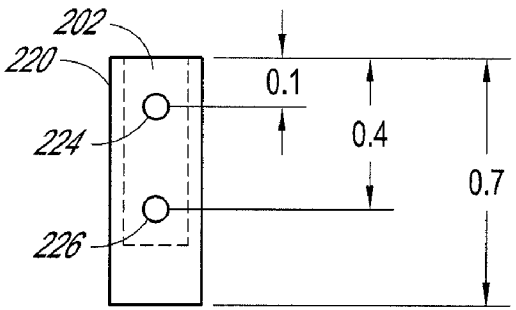
FIG. 2A is an exploded view of a portion of the apparatus shown in FIG. 2.
Figure 2:
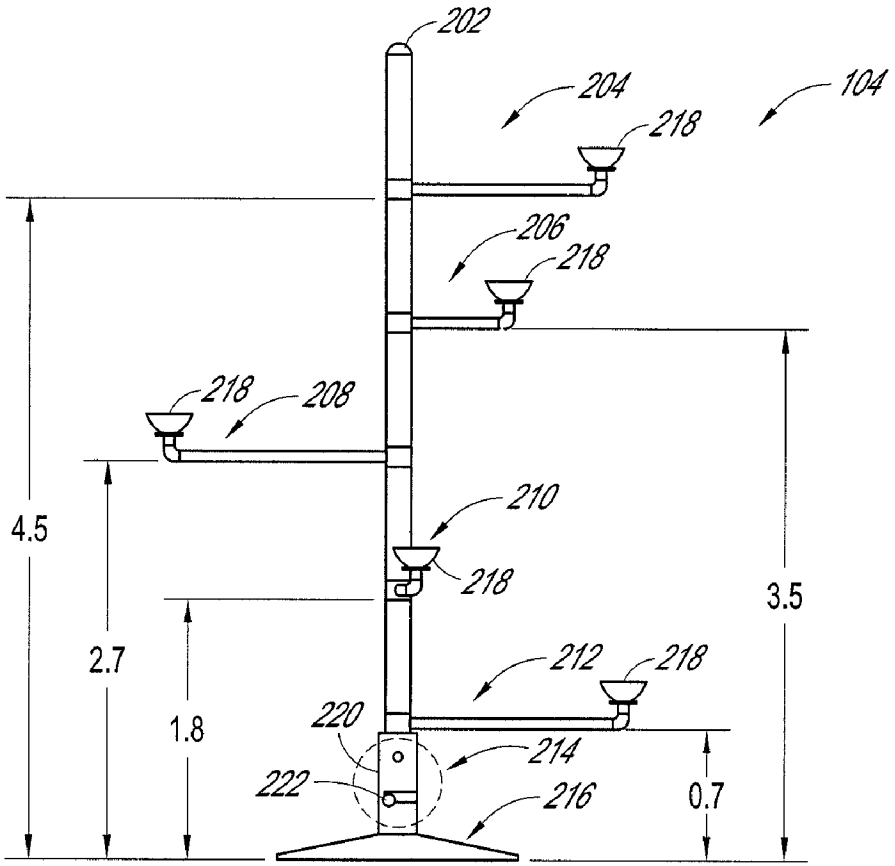
FIG. 2 illustrates an embodiment of an apparatus for training athletes to improve the volley kick skill.

FIG. 2 illustrates a side view of an embodiment of the ball holding apparatus 104. The ball holding apparatus 104 can comprise a central support post 202 that is connected to a support base 216. In an embodiment, the support base 216 can comprise weighted materials for securely anchoring the ball holding apparatus 104 to the ground. The support base 216 can comprise an anchoring mechanism for securing the support base 216 to the ground. The ball holding apparatus 104 can comprise a plurality of extension arms that are configured to hold a ball at various heights from the ground. For example the ball holding apparatus 104 can comprise one, two, three, four, five, six, seven, or more extension arms 204, 206, 208, 210, 212. In an embodiment, the extension arm can comprise a cup 218. The cup 218 can take on a variety of forms, shapes, and sizes to accommodate different kinds and sizes of balls. For example cup 218 can be hemispherical, conical, elliptical, angular, dome, or any other possible form. Additionally, the cup 218 may be made from a variety of materials, including but not limited to flexible material (e.g. silicone) as to enhance the holding strength of the cup and to widen the range of different sized balls a single cup can accommodate. Other materials can include plastics (rigid or soft), rubbers, polymers, metals, or the like.

In an embodiment, the central support post 202 is coupled to support base 216 at a mounting portion 220. The mounting portion 220 can be configured to retain the central support post 202 in a vertical direction and/or a diagonal direction. The mounting portion 220 can take on a variety of different forms. For example, mounting portion 220 can, be a cylindrical pipe portion with an inner diameter that is larger than the outer diameter of the central support post 202. Mounting portion 220 can be configured to receive central support post 202 and can be locked into place using locking mechanism 222.

FIG. 2A illustrates an embodiment of mounting portion 220. Positioned within mounting portion 220 is central support post 202. In an embodiment, central support post 202 can comprise one or more openings 224, 226 for locking the central support post 202 to the mounting portion 220. The mounting portion 220 can comprise at least one corresponding opening through which a locking bolt can be inserted through the mounting portion 220 and into the one or more openings 224, 226 of central support post 202. By positioning the locking bolts into different holes 224, 226 a user of the athletic training apparatus 100 can change the height of the central support post 202.

As illustrated in FIG. 2, the extension arms 204, 206, 208, 210, 212 can be positioned at various heights from the ground depending upon the user of the athletic training apparatus 100. For example extension arm 212 can be positioned 0.9 feet from the ground. In other embodiments the extension arm can be positioned 1.8 feet, 2.7 feet, 4.5 feet, and/or more from the ground. The extension arms can be connected and/or coupled to the central support post 202 to be cantilevered in a substantially horizontal or perpendicular configuration and/or the extension arms can be connected and/or coupled to the central support post 202 to be cantilevered at a diagonal and/or angled direction.

Figure 3:
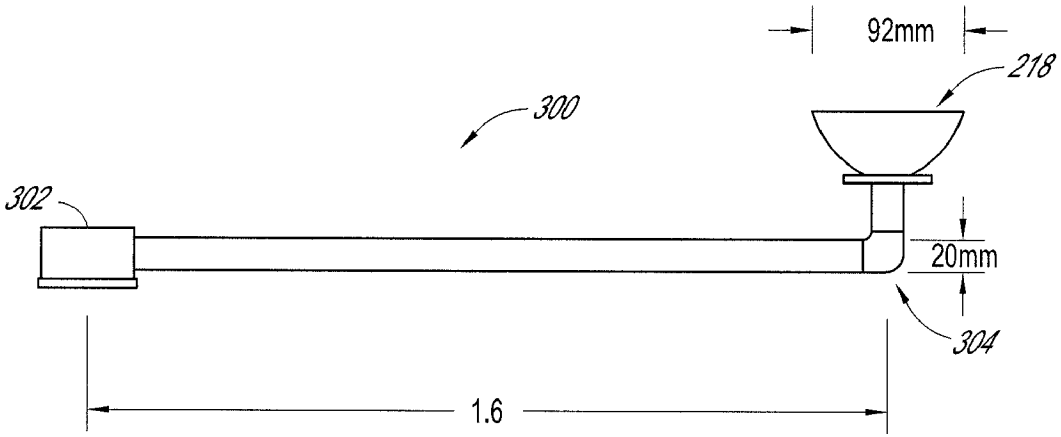
Figure 3A:
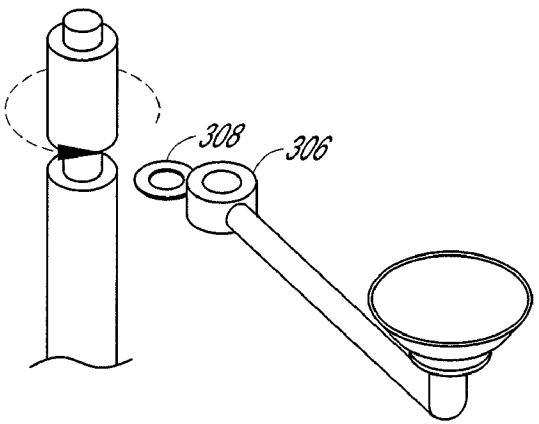
FIG. 3A illustrates how the arm component of FIG. 3 can interact with the apparatus shown in FIG. 2.

FIG. 3 illustrates an exploded view of an extension arm 300. The extension arm 300 can comprise various lengths, for example, about one foot, about 1.6 feet, about three feet, and/or more. The extension arm 300 can comprise a first end 302 and a second end 304. At the first end 302 the extension arm 300 can comprise a coupling mechanism 306 for affixing the extension arm to the central support post 202. As illustrated in FIG. 3A, an embodiment of the coupling mechanism 306 comprises a cylindrical portion with a central lumen dimensioned to receive the central support post 202. In an embodiment, a coupling mechanism 306 also comprises one or more washer 308 that helps enable the extension arm 300 to rotate or swivel about the central support post 202. The second end 304 of extension arm 300 can comprise a bent or curved portion coupled to the cup 218. As described above the cup 218 is configured to hold the ball.

Figure 4B:
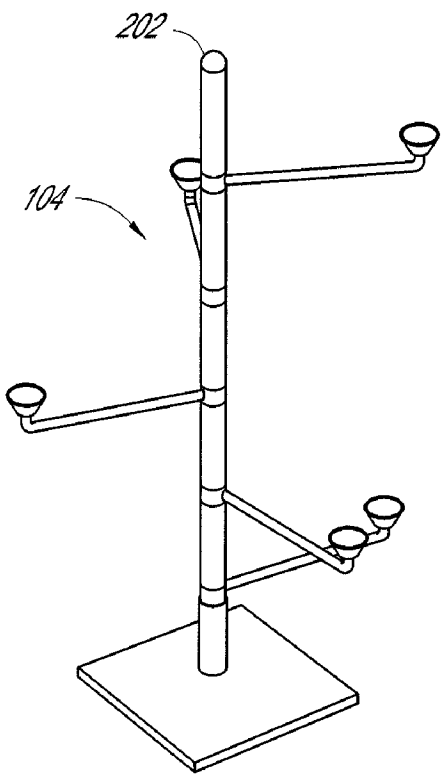
FIGS. 4A and 4B illustrate the apparatus shown in FIG. 2 positioned at different heights.
Figure 4A:
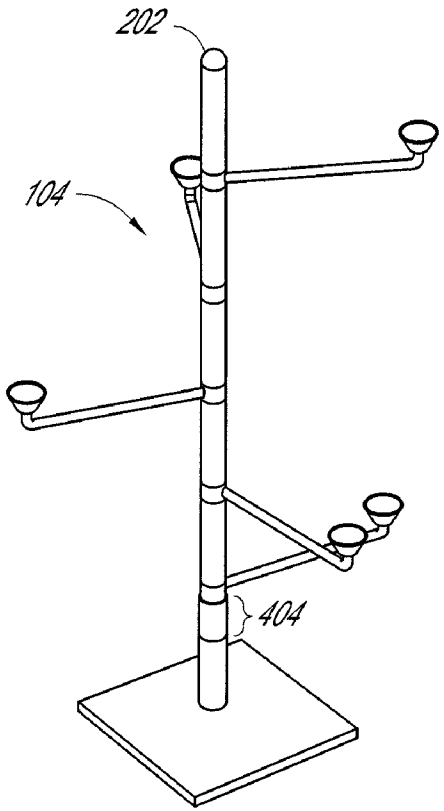
Figure 4:
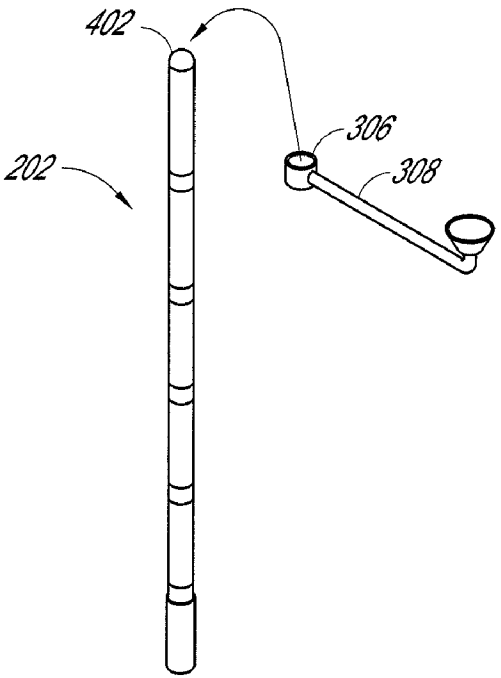
FIG. 4 illustrates an embodiment of a central support element of the apparatus shown in FIG. 2.

FIG. 4 illustrates an embodiment of the central support post 202 without any of the extension arms attached. In an embodiment, an extension arm 300 is positioned on the central support post 202 by sliding the coupling mechanism 306 over the top portion 402 of the central support post 202. The extension arm 300 can thereafter be slid up and down central support post 202. FIG. 4A and FIG. 4B illustrate how the ball holding apparatus 104 can be positioned at different heights. FIG. 4A illustrates how the central support post 202 can be positioned at extended distance 404 as compared to the central support post in FIG. 4B.

Figure 5:
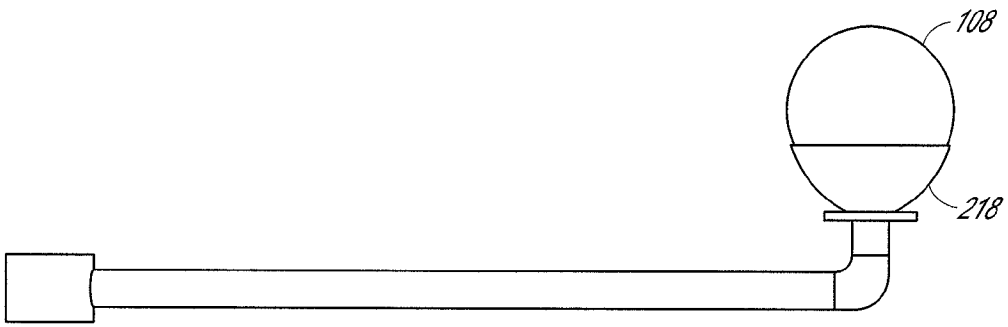
FIG. 5 illustrates the arm component of the apparatus holding a ball.
Figure 5A:
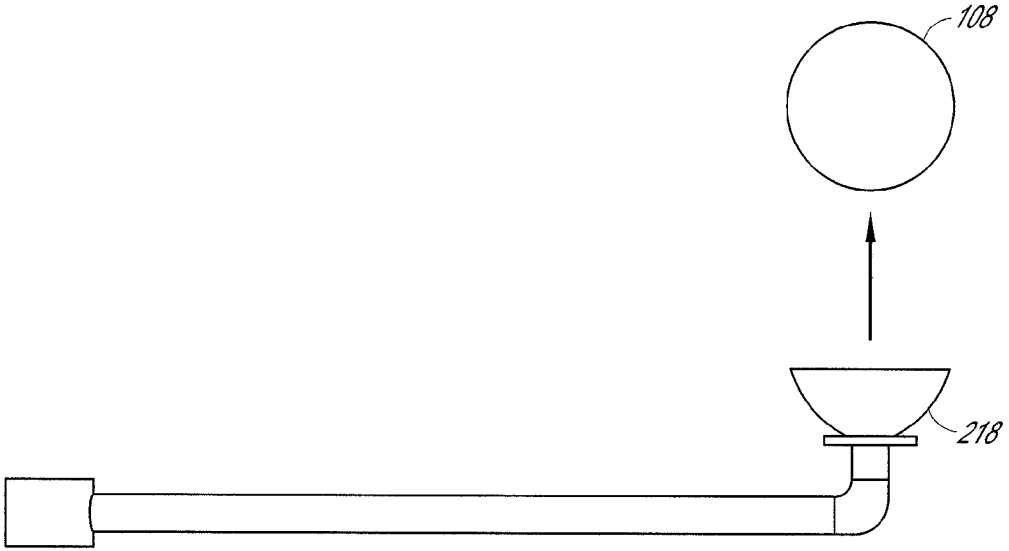
FIG. 5A illustrates how the arm component can be configured to hoist or lift the ball into the air.

In an embodiment, the cup 218 can be configured to hold the ball 108 whereby the user is allowed to kick the ball out of or from the cup 218. FIGS. 5 and 5A illustrate an embodiment of the cup 218 that is configured to hoist, lift, send, toss, or throw the ball 108 into the air. Cup 218 can also include a lifting mechanism that is configured to hoist or throw or send the ball 108 upward into the air thereby allowing the user to kick the ball while in the air. In an embodiment, the ball 108 makes a seal with the cup 218, wherein the cup 218 can be coupled to an air supply whereby a burst or jet of air (pressurized or otherwise) is shot into the interior portion of the cup thereby thrusting the ball into the air. In a similar embodiment, a single cup 218 may comprise multiple air injectors whereby a user may selectively choose which of those air injectors are to shoot a burst or jet of air (pressurized or otherwise), allowing the ball to shoot up spinning in a direction. Alternatively, the cup 218 can comprise a spring mechanism or other suitable mechanism for jettisoning the ball 108 into the air from cup 218. As with the air injection embodiment, a single cup 218 with such spring or other mechanism may also comprise multiple air outlets as to thrust the ball into the air with a spin. Alternatively, ball spin can be provided by a rotary mechanism that spins the ball while it is shooting the ball into the air. Other lifting mechanisms may also be used. The lifting mechanism can be configured to throw the ball vertically or horizontally or a combination thereof.

Figure 6:
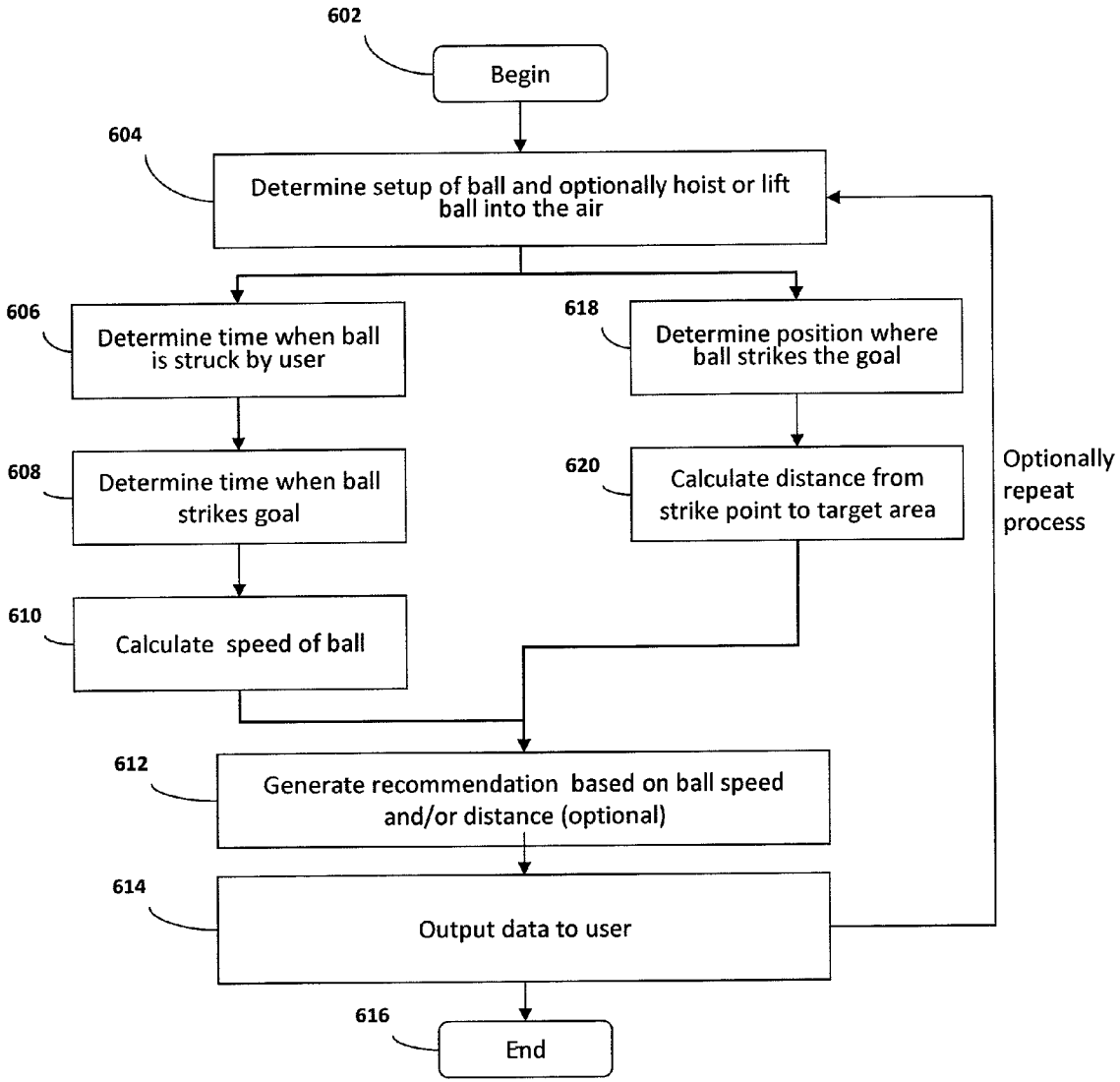
FIG. 6 is a flowchart depicting an embodiment of a process for processing and analyzing data measured from an athlete's volley kick.

FIG. 6 is a flowchart depicting an embodiment of a process for analyzing data measured during a volley kick. The process can begin at block 602 wherein the volley kick control and analysis system 102 determines at block 604 whether the set up of one or more balls are positioned in the ball holding apparatus 104. Optionally the system 102 can be configured to hoist or lift one or more balls into the air for the athlete to kick. At block 606, the system 102 can be configured to collect data from the ball 108, to determine the time when the ball is struck by the user. At block 608, the system 102 can be configured to collect data from goal 106 to determine the time when the ball strikes the goal. At block 610 the system 102 can be configured to calculate the speed at which the ball was traveling based on the data obtained at blocks 606 and 608. At block 612 the system can be optionally configured to analyze the ball's speed to generate a recommendation to the user as to how the athlete can improve his volley kick skills. At block 614 the system can be configured to output the data and/or the recommendation to the user. At block 616 the process can end. In addition to calculating the ball speed, the system 102 can be configured to determine where the ball struck the goal and/or the distance at which the ball was from the targets. For example at block 618 the system 102 can collect data from goal 106 to determine the position where the ball struck the goal. At block 620 the system 102 can optionally calculate the distance from the strike point to the target areas 110, 112, 114. At block 612 the system can be configured to generate a recommendation based on the distance from the target that the user can use to improve his volley kick skills. At block 614 the system 102 can be configured to output the data and/or the recommendation to the user thereby ending the process at block 616.

Computer System

Figure 7:
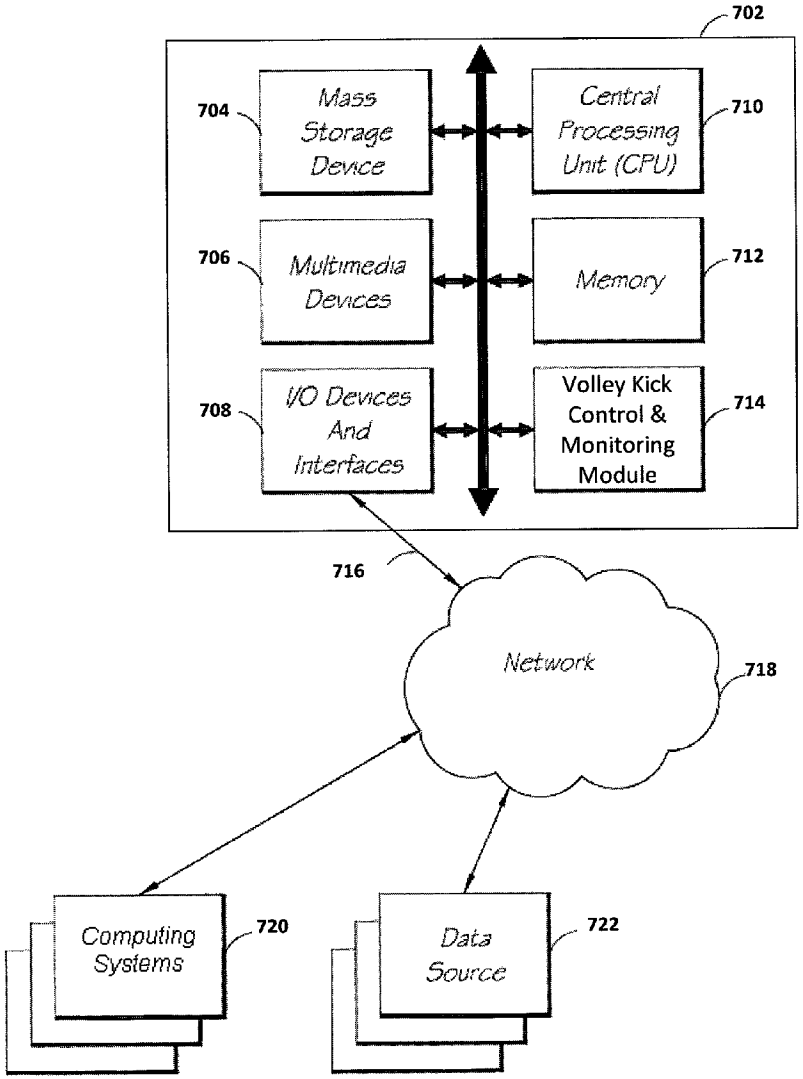
FIG. 7 is a block diagram depicting an embodiment of a computer hardware system configured to run software for implementing one or more embodiments of the volley kick control and analysis modules and processes.

In some embodiments, the systems, processes, and methods described above are implemented using a computing system (which can be a fixed system or mobile device, such as an iPhone, iPad, or other similar device), such as the one shown in FIG. 7. The exemplary computer system 702 is in communication with one or more computing systems 720 and/or one or more data sources 722 via one or more networks 718. While FIG. 7 illustrates an embodiment of a computing system 702, it is recognized that the functionality provided for in the components and modules of computer system 702 may be combined into fewer components and modules, or further separated into additional components and modules.

Soccer Control and Analysis Module

The computer system 702 includes a volley kick control and monitoring module 714 that carries out the functions, methods, acts, and/or processes described herein. The volley kick control and monitoring module 714 is executed on the computer system 702 by a central processing unit 710 discussed further below.

In general the word "module," as used herein, refers to logic embodied in hardware or firmware or to a collection of software instructions, having entry and exit points. Modules are written in a program language, such as JAVA, C or C++, or the like. Software modules may be compiled or linked into an executable program, installed in a dynamic link library, or may be written in an interpreted language such as BASIC letters, PERL, LUA, or Python. Software modules may be called from other modules or from themselves, and/or may be invoked in response to detected events or interruptions. Modules implemented in hardware include connected logic units such as gates and flip-flops, and/or may include programmable units, such as programmable gate arrays or processors.

Generally, the modules described herein refer to logical modules that may be combined with other modules or divided into sub-modules despite their physical organization or storage. The modules are executed by one or more computing systems, and may be stored on or within any suitable computer readable medium, or implemented in-whole or in-part within special designed hardware or firmware. Not all calculations, analysis, and/or optimization require the use of computer systems, though any of the above-described methods, calculations, processes, or analyses may be facilitated through the use of computers. Further, in some embodiments, process blocks described herein may be altered, rearranged, combined, and/or omitted.

Computing System Components

The computer system 702 includes one or more processing units (CPU) 710, which may include a microprocessor. The computer system 702 further includes a memory 712, such as random access memory (RAM) for temporary storage of information, a read only memory (ROM) for permanent storage of information, and a mass storage device 704, such as a hard drive, diskette, or optical media storage device. Alternatively, the mass storage device may be implemented in an array of servers. Typically, the components of the computer system 702 are connected to the computer using a standards based bus system. The bus system can be implemented using various protocols, such as Peripheral Component Interconnect (PCI), Micro Channel, SCSI, Industrial Standard Architecture (ISA) and Extended ISA (EISA) architectures.

The computer system 702 includes one or more input/output (I/O) devices and interfaces 708, such as a keyboard, mouse, touch pad, and printer. The I/O devices and interfaces 708 can include one or more display devices, such as a monitor, that allows the visual presentation of data to a user. More particularly, a display device provides for the presentation of GUIs as application software data, and multi-media presentations, for example. The I/O devices and interfaces 708 can also provide a communications interface to various external devices. The computer system 702 may include one or more multi-media devices 706, such as speakers, video cards, graphics accelerators, and microphones, for example.

Computing System Device/Operating System

The computer system 702 may run on a variety of computing devices, such as a server, a Windows server, and Structure Query Language server, a Unix Server, a personal computer, a laptop computer, and so forth. In other embodiments, the computer system 702 may run on a mainframe computer suitable for controlling and/or communicating with large databases, performing high volume transaction processing, and generating reports from large databases. The computing system 702 is generally controlled and coordinated by an operating system software, such as z/OS, Windows 95, Windows 98, Windows NT, Windows 2000, Windows XP, Windows Vista, Windows 7, Lenox, BSD, SunOS, Solaris, Mac OS, or other compatible operating systems, including proprietary operating systems. Operating systems control and schedule computer processes for execution, perform memory management, provide file system, networking, and I/O services, and provide a user interface, such as a graphical user interface (GUI), among other things.

Network

The computer system 702 illustrated in FIG. 7 is coupled to a network 718, such as a LAN, WAN, or the Internet via a communication link 716 (wired, wireless, or a combination thereof). Network 718 communicates with various computing devices and/or other electronic devices. Network 718 is communicating with one or more computing systems 720 and one or more data sources 722. The volley kick control and monitoring module 714 may access or may be accessed by computing systems 720 and/or data sources 722 through a web-enabled user access point. Connections may be a direct physical connection, a virtual connection, and other connection type. The web-enabled user access point may include a browser module that uses text, graphics, audio, video, and other media to present data and to allow interaction with data via the network 718.

The browser module or other output module may be implemented as a combination of an all-points addressable display such as a cathode ray tube (CRT), a liquid crystal display (LCD), a plasma display, or other types and/or combinations of displays. The output module may be implemented to communicate with input devices 708 and they also include software with the appropriate interfaces which allow a user to access data through the use of stylized screen elements, such as menus, windows, dialogue boxes, tool bars, and controls (e.g., radio buttons, check boxes, sliding scales, and so forth). Furthermore, the output module may communicate with a set of input and output devices to receive signals from the user.

Other Systems

The computing system 702 can include one or more internal and/or external data sources (e.g., data sources 722). In some embodiments, one or more of the data repositories and the data sources described above may be implemented using a relational database, such as DB2, Sybase, Oracle, CodeBase, and Microsoft® SQL Server as well as other types of databases such as a flat-file database, an entity relationship database, and object-oriented database, and/or a record-based database. The computing system 702 can include a global positioning system (GPS) for tracking the position of a ball or other similar object that the athlete strikes.

Additional Embodiments

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Additionally, the skilled artisan will recognize that any of the above-described methods may be carried out using any appropriate apparatus. Further, the disclosure herein of any particular feature, aspect, method, property, characteristic, quality, attribute, element, or the like in connection with an embodiment may be used in all other embodiments set forth herein. Thus, it is intended that the scope of the present invention herein disclosed should not be limited by the particular disclosed embodiments described above.

Conditional language, such as, among others, "may," "could," "might," or "may," unless specifically stated otherwise, or otherwise understood within the context as used, is generally intended to convey that certain embodiments include while other embodiments do not include, certain features, elements and/or blocks. Thus, such conditional language is not generally intended to imply that features, elements and/or blocks are in any way required for one or more embodiments or that one or more embodiments necessarily include logic for deciding, with or without user input or prompting, whether these features, elements and/or steps are included or are to be performed in any particular embodiment.

What is claimed is:

1. A volley kick training system, the system comprising:

one or more sensors configured to be coupled to a soccer goal net, wherein the one or more sensors are configured to detect a location where a soccer ball has struck the soccer goal net and a point in time when the soccer ball has struck the soccer goal net;

a control module in communication with the one or more sensors; and a volley kick training apparatus comprising:

a base portion having a weighted portion or an anchor portion;

a central post portion having an attachment mechanism for releasably coupling the central post portion to the base portion;

a plurality of cantilevered arm portions having a first end and a second end, the first end having a connector mechanism for releasably coupling the plurality of cantilevered arm portions to the central post portion to allow the cantilevered arm portions to project radially outward from the central post portion, wherein the connector mechanism allows the plurality of cantilevered arm portions to be removed from the central post portion to allow the volley kick training apparatus to be collapsible for easy storage and transfer, and the second end having a connector mechanism; and at least one soccer ball holder having a substantially dome shaped configuration, the soccer ball holder comprising a mounting mechanism for releasably coupling the soccer ball holder to the connector mechanism of the second end of the plurality of cantilevered arm portions, the soccer ball holder comprising a silicon material, the silicon material configured to be sufficiently stiff for holding the soccer ball and sufficiently flexible to allow a user to kick the soccer ball off the soccer ball holder without injuring a foot of the user, and the soccer ball holder further configured to hold the soccer ball positioned on the soccer ball holder using suction, wherein the soccer ball holder has a diameter of about one inch.

2. The volley kick training system of claim 1, wherein the plurality of cantilevered arm portions are adjustable along the height of the central post portion.

3. The volley kick training system of claim 1, wherein the connector mechanism is a swivel mount to allow the plurality of cantilevered arm portions to rotate about the central post when the user kicks the soccer ball from the at least one soccer ball holder.

4. The volley kick training system of claim 1, wherein the connector mechanism is a friction lock mount to allow the plurality of cantilevered arm portions to remain stationary with respect to the central post when the user kicks the soccer ball from the at least one soccer ball holder.

5. The volley kick training system of claim 1, wherein the at least one soccer ball holder comprises a rim portion configured to form a seal with the soccer ball when the soccer ball is placed inside the at least one soccer ball holder, wherein the seal is sufficiently strong to hold the soccer ball within the at least one soccer ball holder and sufficiently weak to allow the user to kick the soccer ball from the at least one soccer ball holder.

6. The volley kick training system of claim 1, wherein each one of the plurality of cantilevered arm portions is further configured to be coupled to the central post portion to be cantilevered in a diagonal direction.

7. The volley kick training system of claim 1, wherein the control module is further configured to output a speed of the soccer ball based on a point in time when the soccer ball was struck and the point in time when the soccer ball has struck the soccer goal net.

8. The volley kick training system of claim 1, wherein the control module is further configured to output a recommendation for improving a volley kick of a user based on the location where the soccer ball has struck the soccer goal net and the point in time when the soccer ball has struck the soccer goal net.

9. The volley kick training system of claim 1, wherein the central post portion and the base portion form an angle of substantially 90 degrees.

10. The volley kick training system of claim 1, wherein the central post portion and the base portion form an angle other than 90 degrees.

11. The volley kick training system of claim 1, wherein a height of the volley kick training apparatus is adjustable.

12. A volley kick training system, the system comprising:

one or more sensors configured to be coupled to a soccer goal net, wherein the one or more sensors are configured to detect whether a soccer ball has struck the soccer goal net; and a volley kick training apparatus comprising:

a base portion having a weighted portion or an anchor portion;

a central post portion having an attachment mechanism for releasably coupling the central post portion to the base portion;

a plurality of cantilevered aim portions having a first end and a second end, the first end having a connector mechanism for releasably coupling the plurality of cantilevered arm portions to the central post portion to allow the cantilevered arm portions to project radially outward from the central post portion, the second end having a connector mechanism; and at least one soccer ball holder having a substantially dome shaped configuration, the soccer ball holder comprising a mounting mechanism for releasably coupling the soccer ball holder to the connector mechanism of the second end of the plurality of cantilevered arm portions, the soccer ball holder comprising a silicon material, the silicon material configured to be sufficiently stiff for holding the soccer ball and sufficiently flexible to allow a user to kick the soccer ball off the soccer ball holder without injuring a foot of the user.

13. The volley kick training system of claim 12, wherein the plurality of cantilevered arm portions are adjustable along the height of the central post portion.

14. The volley kick training system of claim 12, wherein the connector mechanism is a swivel mount to allow the plurality of cantilevered arm portions to rotate about the central post when the user kicks the soccer ball from the at least one soccer ball holder.

15. The volley kick training system of claim 12 further comprising a control module in communication with the one or more sensors.

16. The volley kick training system of claim 12, wherein the connector mechanism of the first end of the plurality of cantilevered arm portions is configured to allow the plurality of cantilevered arm portions to be removed from the central post portion to allow the volley kick training apparatus to be collapsible for easy storage and transfer.

17. The volley kick training system of claim 12, wherein the soccer ball holder is further configured to hold the soccer ball positioned on the soccer ball holder using suction.

18. The volley kick training system of claim 12, wherein the soccer ball holder has a diameter of about one inch.

19. The volley kick training system of claim 12, wherein the at least one soccer ball holder comprises a rim portion configured to form a seal with the soccer ball when the soccer ball is placed inside the at least one soccer ball holder, wherein the seal is sufficiently strong to hold the soccer ball within the at least one soccer ball holder and sufficiently weak to allow the user to kick the soccer ball from the at least one soccer ball holder.

20. The volley kick training system of claim 12, wherein each one of the plurality of cantilevered arm portions is further configured to be coupled to the central post portion to be cantilevered in a diagonal direction.

* * * * *